United States Patent [19]

El-Nashar et al.

[11] Patent Number: 4,796,595

[45] Date of Patent: Jan. 10, 1989

[54] FREE-RUNNING PRESSURE WAVE SUPERCHARGER DRIVEN BY GAS FORCES

[75] Inventors: Ibrahim El-Nashar, Kloten; François Jaussi, Wettingen; Hubert Kirchhofer, Gebenstorf; Christian Komauer, Rieden; Andreas Mayer, Niederrohrdorf; Josef Perevuznik, Fislisbach; Fritz Spinnler, Arisdorf, all of Switzerland

[73] Assignee: BBC Brown, Boveri Ltd., Baden, Switzerland

[21] Appl. No.: 13,931

[22] Filed: Feb. 11, 1987

[30] Foreign Application Priority Data

Feb. 28, 1986 [CH] Switzerland ..... 826/86

[51] Int. Cl.[4] ..... F02B 33/42

[52] U.S. Cl. ..... 123/559.2; 417/64

[58] Field of Search ..... 123/559; 417/64

[56] References Cited

U.S. PATENT DOCUMENTS

| | | | |
|---|---|---|---|
| 2,853,987 | 9/1958 | Berchtold et al. | 123/559 |
| 4,232,999 | 11/1980 | Croes et al. | 123/559 X |
| 4,414,952 | 11/1983 | Fried et al. | 123/559 |
| 4,662,342 | 5/1987 | Altmann et al. | 123/559 |

FOREIGN PATENT DOCUMENTS

| | | |
|---|---|---|
| 225426 | 5/1946 | Switzerland . |
| 550937 | 6/1974 | Switzerland . |

*Primary Examiner*—Michael Koczo

*Attorney, Agent, or Firm*—Burns, Doane, Swecker & Mathis

[57] ABSTRACT

In a free-running pressure wave supercharger driven by the gas forces, nozzles (27) are provided in the gas casing (6) and possibly also in the air casing (5), which nozzles are connected—via a drive line (26)—with a position in the air casing (5), preferably with the high-pressure air port (2), at which position a surplus pressure relative to the nozzle entry occurs during the run-up phase of the pressure wave supercharger. A control device 15 actuates a supercharge air flat (14) in the port (2) and a valve device (23+25) in the drive line (26) in the opposite sense, i.e. if the supercharge air flap (14) holds the port (2) closed, the valve device (23+25) frees the flow through the drive line (26) to the nozzle (27) and vice versa. The diaphragm capsule (17) of the control device (15) is subjected, on one side, to the pressure in a compression pocket (11) via a control pressure line (19) and, on the other side, to the pressure before the supercharge air flap (14) in the port (2). During the run-up phase, the pressure in the compression pocket (11) exceeds the pressure in front of the supercharge air flap (14) and the nozzle (27) receives drive air. As soon as the pressure in front of the supercharge air flap (14) exceeds the pressure in the compression pocket (11), the supercharge air flap (14) opens and simultaneously closes the valve device (23+25). The nozzle (27) is switched off and the further drive is then mainly provided by the high-pressure exhaust-gas jet from the port (3) entering obliquely to the direction of the rotor peripheral velocity.

20 Claims, 7 Drawing Sheets

FREE-RUNNING PRESSURE WAVE SUPERCHARGER DRIVEN BY GAS FORCES

The present invention relates to a free-running pressure wave supercharger driven by gas forces.

BACKGROUND OF THE INVENTION

In the use of pressure wave superchargers as supercharge air compressors for internal combustion engines, the drive of the pressure wave supercharger rotor in the currently practiced state of technology takes place at a constant transmission ratio from the engine itself. The rotational speed of the rotor is therefore proportional to the engine rotational speed. The drive elements conventionally used for this purpose are V-belts, V-belt pulleys and belt tensioners. Although this type of drive has been proven in practice, there are still extra requirements, mainly because of the high transmission ratio between the engine and the pressure wave supercharger and the associated high belt and bearing peripheral speeds and also because of the severe transverse bearing loads due to the belt tension. The forces from the engine vibrations transferred via the belts to the pressure wave supercharger also contribute to the bearing loads. The pressure wave superchargers intended for the engines of passenger cars are also fairly small at relatively high engine powers. They do not therefore provide sufficient installation space for large rolling contact bearings capable of carrying heavy loads instead of the currently used rolling contact bearing sizes, whose dimensions have to be kept as small as possible for the reasons given below and whose rolling bodies therefore often run even without an inner race directly on a hardened section of the rotor shaft. These bearing designs make it possible to keep the rotor with its pressure exchange cells as small as is permitted by the exhaust gas and air throughput necessary for a specified power range of an engine. The smaller the shaft, bearing and thus also the rotor hub can be designed, therefore, the smaller the external dimensions of the rotor and hence of the complete pressure wave supercharger can be kept. In the case of direct mechanical drive of the rotor by the engine, however, lower limits are set to the bearing dimensions by the abovementioned factors of high transmission ratio, high bearing peripheral speed (and by the large amount of frictional heat caused by the high bearing peripheral speeds, which is difficult to remove because of the compact dimensions) and, especially because of the severe transverse loading due to the drive belts and the engine vibrations. The requirement for a particular minimum life of the bearings is thus a factor opposing further reduction of the bearing dimensions in this drive concept.

If the belt tension is avoided or if no use is made at all of any other driving element which causes transverse loading on the bearings, the mechanical and hence also the thermal bearing loads are reduced and, consequently, the bearing life is increased for the currently usual bearing dimensions. In a particular case, the bearings can be dimensioned so as to economize in space at a life which is otherwise the same. The transverse loading can, for example, be avoided by direct co-axial coupling of the rotor shaft to an electrical, hydraulic or similar drive source and, of course, also by coupling to an intermediate drive which accepts the transverse load due to the belt tension or the like and whose shaft has a coupling flange at the supercharger end and, at the other end, as usual preferably a belt pulley. Chain and gearwheel drives are practically out of the question as drive because of the large transmission ratios between the engine crankshaft and the rotor shaft of the pressure wave supercharger.

However, the abovementioned drives with intermediate drive, which are free from transverse forces, are also associated under certain circumstances with a decisive disadvantage for practical application. This is the limited freedom in the choice of the arrangement of the pressure wave supercharger in the engine compartment of a motor vehicle. In the case of belt drive, with or without intermediate drive, for example, the rotor shaft must be located parallel to the engine crankshaft—if unfavorable angle drives are not to be accepted. Electrical and hydraulic drives offer more freedom in this respect but are in turn more complicated, therefore more expensive and are also more difficult to deal with from a control point of view. Because the belt drive, together with the belt tensioning device, occupies one belt plane in the engine compartment, it makes the accommodation of the belt drive for the other auxiliaries more difficult. Full freedom in the arrangement of a pressure wave supercharger at economically justifiable cost is therefore provided, in practice, only by exhaust-gas drive, as in the case of exhaust-gas turbochargers. The supply of the exhaust gases to the exhaust gas casing of the pressure-wave supercharger, with its control edges and ports, can be carried out without any problems by an easily designed exhaust-gas duct and many possibilities are conceivable for converting the flow energy of the exhaust gases into the rotational motion of the rotor. Examples of such possibilities are tangential action on the rotor cell walls or on rows of blade rings specially provided for this purpose in association with elements fixed to the casing for the deflection and, if required, locally distributed concentration of the exhaust-gas flow into the rotor casing or into a ring of blading provided for that purpose in order to generate a tangential component of the inlet velocity of the exhaust-gas flow.

As a further disadvantage of the positively driven pressure wave supercharger, which has to be avoided, is the risk of a crack in the belt which demands expensive measures for emergency operation which must still ensure safe return home of the vehicle under its own power.

There is also difficulty in controlling the belt tension, which can be too large or too small and can therefore overload the bearing or lead to slip and, in consequence, premature belt wear. Because of the high rotational speed of the pressure wave supercharger, the problem of low pressure scavenging arises in the higher idling speed range of the engine and, similarly, incorrect flows to the rotor with corresponding inlet flow losses occur due to the fixed drive transmission ratio in certain operating ranges.

As already stated, an important advantage of the exhaust-gas-driven pressure wave supercharger with rolling contact bearings is that it can be arranged in any given position relative to the engine, including transversely or at any given angle or even at right angles to it.

Still further advantages should, however, be mentioned. The disappearance of the transverse load on the bearings permits the use of smaller bearings; in consequence, as also already mentioned, the peripheral velocity of the rolling bodies and hence, at the same rotational speed, the thermal loading becomes smaller relative to pressure wave superchargers with larger bearings. The smaller bearing diameters make it possible to increase the free cell cross-section for the same external dimensions of the supercharger, i.e. to increase the usable flow cross-section of the rotor. The supercharger can therefore be used for a larger engine. Advantages also appear with respect to the critical rotational speed, which appears at a greater distance from the rotational speed range at which the supercharger is mainly operated. Similarly, the response behavior becomes better during all acceleration procedures, provided the charging limit of the rotor is not exceeded. At low full-load rotational speeds of the engine, the exhaust-gas-driven rotor will also run more rapidly than one driven at a fixed transmission ratio from the engine. This reduces the pulsation of the charge air supply otherwise present at low rotational speeds and permits a smaller receiver volume, which in turn reduces the thermal inertia and makes the exhaust-gas receiver cheaper.

Pressure wave machines whose rotor is driven by a gas which has to be expanded independently of a prime mover are known from the patent literature. In contrast to the pressure converters mainly used as charging machines and which convert the energy contained in the exhaust-gas flow of an engine to increase the pressure of a supercharge airflow of approximately the same weight, the pressure of this supercharge air flow being above that of the exhaust-gas flow, the patents mentioned concern pressure exchangers, in which the air to be compressed is brought approximately to the pressure of the expanding medium, i.e. the exhaust gases of an engine, for example, or, in the case of the use of a pressure exchanger as the high pressure stage of a gas turbine, air heated in a combustion chamber or by a heat exchanger. In such a pressure exchanger, the energy of the exhaust gases or of the heated air serves to compress a quantity of cold air which is larger than the quantity of the exhaust gases or heated air to be expanded. Since in an engine, the supercharge airflow is approximately equal to the exhaust-gas flow, there is generally no requirement for the surplus air so that pressure exchangers are scarcely considered for supercharging but are considered, as stated, as the high pressure compressor or gas turbine in association with a conventional axial or centrifugal compressor as the low pressure compressor part and also for refrigerating machines, heat pumps, chemical processes, pressure fired steam boilers, etc.

Such a pressure exchanger is known from Swiss Patent No. 225,426. In the rotor of this pressure exchanger, the cell walls are inclined relative to an axial section plane, approximately in the form of a helical surface, or are curved in blade shape. The actual desired objective of cell walls formed in such a way consists in avoiding or reducing the shock losses of the gases taking place in the pressure exchange process at entry into or outlet from the rotor cells. The absolute outlet velocity relative to the rotor receivers a peripheral component so that the absolute outlet velocity is reduced; in contrast, the inlet of the gas can take place with shock, which drives the rotor.

A further pressure exchanger, which is located as the high pressure compressor between a low pressure axial compressor and a gas turbine and whose rotor can be either coupled to the turbine shaft or provided with its own drive independent of the gas turbine, is described in Swiss Patent No. 550,937. There is no mention of self-drive in this patent specification. It describes, rather, how the pressure difference between the expanding hot gas and the cold gas to be compressed in the low pressure zone can be increased by means of a special design of the rotor cells without simultaneously increasing the corresponding pressure difference on the high pressure side, in order to unload the compressor and, by this means, to increase the useful power and efficiency of the installation.

A pressure exchanger with self-drive by the pressure transmitting medium is, on the other hand, described in British Patent No. 921,686. In this, the cell walls on the inlet side are curved over one third of their length but are parallel to the axis in the other part and the associated inlet ports are inclined relative to the end surface of the rotor in such a way that they enter tangentially into the curved section of the rotor cells. The force driving the rotor arises due to the deflection of the inflowing medium on the curved part of the cell walls of the rotor.

The previously mentioned pressure wave machines are pressure exchangers which, as stated, can hardly be considered for the supercharging of internal combustion engines. This is reserved for pressure wave superchargers acting as pressure converters, in which achievement of the drive by the engine exhaust gases requires a series of measures which extend beyond the shaping of the cell walls of the rotor to deflect or change the direction of the exhaust gas flow and which may not previously have been proposed because a usable concept of a pressure converter which satisfies the operational requirements to be met by a supercharging unit is not known. There should, therefore, be hardly anything to discover in the relevant state of technology. A practically usable pressure wave supercharger with self-drive includes inter alia, a starting valve device, by means of which satisfactory engine starting and accelerating from rest under load in the cold condition, restarting the hot engine and driving away under load without delay is possible. It must ensure that the rotor supplies the supercharge airflow necessary for a sufficiently large acceleration torque and that for the particular part-load. Acceleration difficulties of the pressure wave supercharger in the case of a cold engine are caused by the fact that the grease in the rolling contact bearings is still stiff and/or by dirt in the rotor and hence increased friction between the casing and the end surfaces of the rotor. Such a starting valve, in association with other elements, also has to ensure satisfactory low idle running because otherwise, the rotor rotational speed would be so low that the particles contained in the exhaust-gas flow could pass over onto the air side. Devices such as throttle valves, wastegate and the like matched to the characteristic of the free-running pressure converter have to be provided for the control of the supercharge airflow over the whole of the load range.

In principle, the exhaust gas flow can be used without further measures to drive a rotor with cell walls parallel to the axis because of the swirl flow always present. This "natural" swirl flow is not, however, capable of accelerating the rotor sufficiently rapidly and to sufficiently high rotational speeds corresponding to the particular load conditions.

As stated and as appears from the relevant publications discussed, the known relevant means for driving a free-running rotor consist of cell walls curved or oblique to the rotor axis or cell wall parts in association with exhaust-gas inlet flow ducts correspondingly inclined to the rotor axis for increasing the velocity component of the exhaust-gas flow acting in the peripheral direction of the rotor. These means alone, however, do not suffice in their known form to meet the requirements placed on an actual pressure wave supercharger. They therefore have to be adapted to these requirements, more effectively designed and supported by elements to concentrate the exhaust-gas flow. Since the exhaust-gas flow energy necessary to drive the rotor is not, of course, available for the compression work to be transferred to the air, the increase in the leakage gaps (caused by the different amounts of heating and the different material expansion coefficients of the rotor and casing) between the end surfaces of the rotor and the gas and air casings during unsteady state operating conditions, such as starting and acceleration, must be kept as evenly small as possible in the interest of good compression efficiency.

The present invention achieves the objective of producing an exhaust-gas-driven pressure wave supercharger acting as a pressure converter, which pressure wave supercharger satisfies the requirements sketched above and avoids the disadvantages described of the pressure wave supercharger driven at a constant transmission ratio by the engine.

DESCRIPTION OF THE DRAWINGS

The invention is described in more detail below, making reference to the diagrams and embodiment examples devices necessary for a practically usable freeing pressure wave supercharger, these devices being shown in the drawing.

In the drawing.

DETAILED DESCRIPTION

Figure 1:
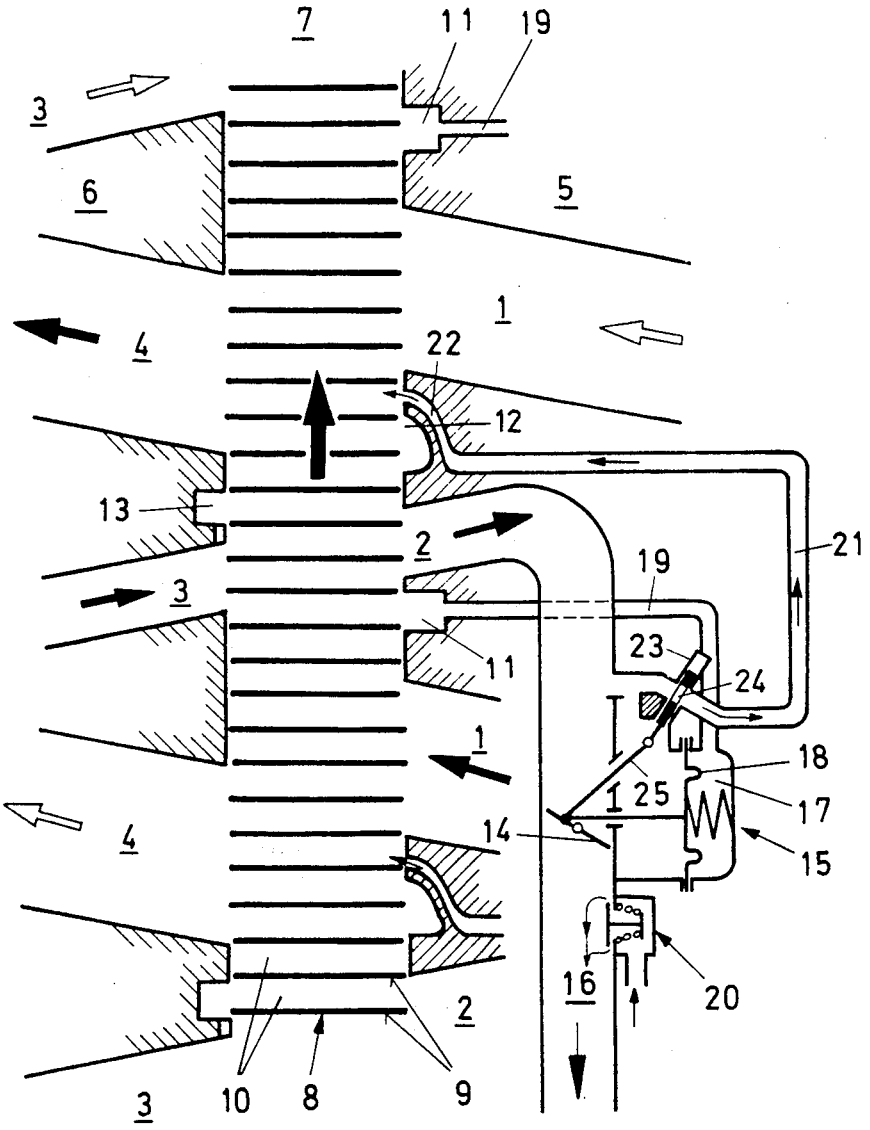
FIGS. 1–5 are views of different embodiments having nozzles in the air or gas casing, which are fed by the supercharger air in the starting phase, with devices for controlling the supercharge airflow.

FIG. 1 is a schematic view of a first design example, the part of a free-running pressure wave supercharger essential for understanding the invention, i.e., a cylindrical section through the rotor, the gas casing and the air casing at half the height of the rotor cells developed in a plane. Of the two cycles present in the casings, one is shown with all its elements, whereas only the ports of the second cycle adjacent to the first cycle are shown. By "cycle" is here meant, as is general in the case of pressure wave machines, the totality of the gas and air ports, the expansion pockets, compression pockets and other auxiliary ducts necessary for the functioning of a pressure wave process. The two cycles are displaced at 180° relative to one another in the air casing 5 and the gas casing 6. The main ports 1 to 4 enter at plane end surfaces of the air and gas casings 5 and 6 in a rotor casing 7, which encloses a cell rotor 8 with cell walls 9 with overhung support in known manner in the air casing 5. The cell walls 9 form the boundaries of rotor cells 10. The main ports are a low pressure air port 1, which induces the air from ambient pressure into the rotor cells 10 and which is, therefore, referred to below as the induction air port, a high-pressure air port 2, which is referred to below as the supercharge air port, a high pressure exhaust-gas port 3, through which the combustion gases expelled from the engine are fed into the rotor cells 10, where they compress the induced air to the supercharge air pressure, and a low-pressure exhaust-gas port 4, referred to below as the exhaust port, through which the exhaust gases expanded in the rotor cells 10 are led into the open air. The flow arrows belonging to one cycle in the ports 1 to 4 are solidly black and those belonging to the second cycle are only shown in outline.

A cycle also includes auxiliary ports in the air casing and the gas casing. These auxiliary ports serve to maintain a functioning pressure wave process, in a known manner, over the whole of the operating range of an engine, i.e. in addition to the particularly important operating range for which the ports 1 to 4 and their opening and closing edges are optimally designed. These auxiliary ports are, in the present case, a compression pocket 11 in the air casing 5 between the induced air port 1 and supercharge air port 2. It is located directly in front of the latter, as seen in the direction of rotation of the rotor. Another auxiliary port is an expansion pocket 12 located between the supercharge air port 2 and the induced air port 1 of the following cycle. In the gas casing 6, a gas pocket 13 is directly after the high-pressure exhaust-gas port 3, again as seen in the direction of rotation of the rotor which is symbolized by the thick black arrow in the rotor cell development.

For practical operation of a pressure wave supercharger for vehicle engines, a supercharge air flap 14 centrally pivotably supported is also provided in the supercharge air line 16, which connects the supercharge air port 2 of the air casing 5 to the air inlet ducts of the engine, which is not shown. The supercharge air flap 14 is actuated, for example, by a control device 15. The actuator of this control device 15 is formed by a diaphragm capsule 17 whose spring-loaded diaphragm 18 is subject, on one side, to the pressure in the supercharge air port 2 and, on the other side, to the pressure acting in the compression pocket 11 via a control pressure line 19. As long as the latter is dominant, the supercharge air flow 14 blocks the supercharge air port 2. Other process pressures or a suitable vacuum dependent on or controlled by the pressure wave process of the operating condition of the engine can also be considered for control.

In this phase, with the supercharge air port 2 blocked, the engine operates as a normally induced engine by inducing air directly from the environment via a weakly spring-loaded breather valve 20. As soon as the rotor 8 of the supercharger comes up to high speed and the engine is loaded, the pressure wave process functions so that air is already compressed. In consequence, the pressure in front of the supercharge air flap 14 increases, but, at the same time, the pressure in the compression pocket 11 decreases so that the diaphragm 18 pivots the flap 14 into the open position. As soon as the pressure in the supercharge airflow exceeds the ambient pressure, the breather valve 20 remains closed and the engine receives only compressed air from the supercharger.

The measures for increasing the acceleration torque during the starting phase are first described below. In order to start the rotor moving, the supercharge air flap 14 must be closed during the starting phase but the supercharge port 2 before the flap 14 must be unloaded by some sort of opening because, with the flap 14 closed, air flowing back from the supercharge air port 2 into the rotor 8 would adversely affect the action of the torque generating exhaust-gas flow. The exhaust-gas flow, which flows in at an accute angle, measured between the positive directions of the vectors of the rotor peripheral velocity and the inlet velocity of the high-pressure exhaust gas, has a driving effect from the initial ignition of the engine but would be weakened by the air flowing back. The relief flow of the supercharged air through the opening mentioned is utilized at an advantageously situated position of the air casing 5 to drive the rotor and is thus resupplied to the pressure wave process.

For the present task of running up the rotor 8 from rest in a free-running state without mechanical coupling to the engine, the control device 15 can be coupled to an additional device, consisting of a driving line 21, which combines the space in front of the supercharge air flap 14 with a position in the land between the expansion pocket 12 and the induction air port 1 and which emerges in this land in a nozzle 22, and with a slide valve 23 in this driving line, whose slide 24 is connected by a rod to the flap 14. The nozzle 22 here forms the opening mentioned for relieving the supercharge air port 2 during starting.

FIG. 1 shows the slide 24 in a position in which it opens the flow cross-section of the driving line 21. Since the pressure, in the case of a rotor at rest or rotating very slowly, is higher in the supercharge air port 2 than at the point of emergence of the nozzle 22, part of the air backed up in front of the flap 14, which air is still polluted with exhaust gas from the high-pressure exhaust-gas port 3 during this phase, flows out of the supercharge air port via the driving line 21 to the nozzle 22; which deflects a concentrated driving jet against the cell walls of the rotor and accelerates up its rotational speed until the pressure in the supercharge air port has reached a level sufficient to open the supercharge air flap 14. The resulting pivoting movement of the supercharge air flap 14 into its open position causes, via the rod 25, a closing movement of the slide 24 which, in consequence, shuts off the driving air flow to the nozzle 22. The rotational speed is then subsequently maintained mainly by the peripheral components of the high-pressure exhaust gas flowing into the rotor space at an acute angle and it is increased or reduced to suit the changes in load. The peripheral component of the induction air flowing from the port 1 into the rotor space, again at an acute angle, also contributes to a small extent.

The location of the nozzle for the driving jet in the land between the expansion pocket 12 and the induction air port 1 has the advantage that the air/exhaust-gas mixture blown in at this point reaches the low-pressure exhaust-gas port 4 by the shortest route and does not flow back into the induction air port 1. The driving jet supports, by this means, the scavenging of the exhaust gas from the rotor cells into the low-pressure exhaust-gas port 4.

Figure 2:
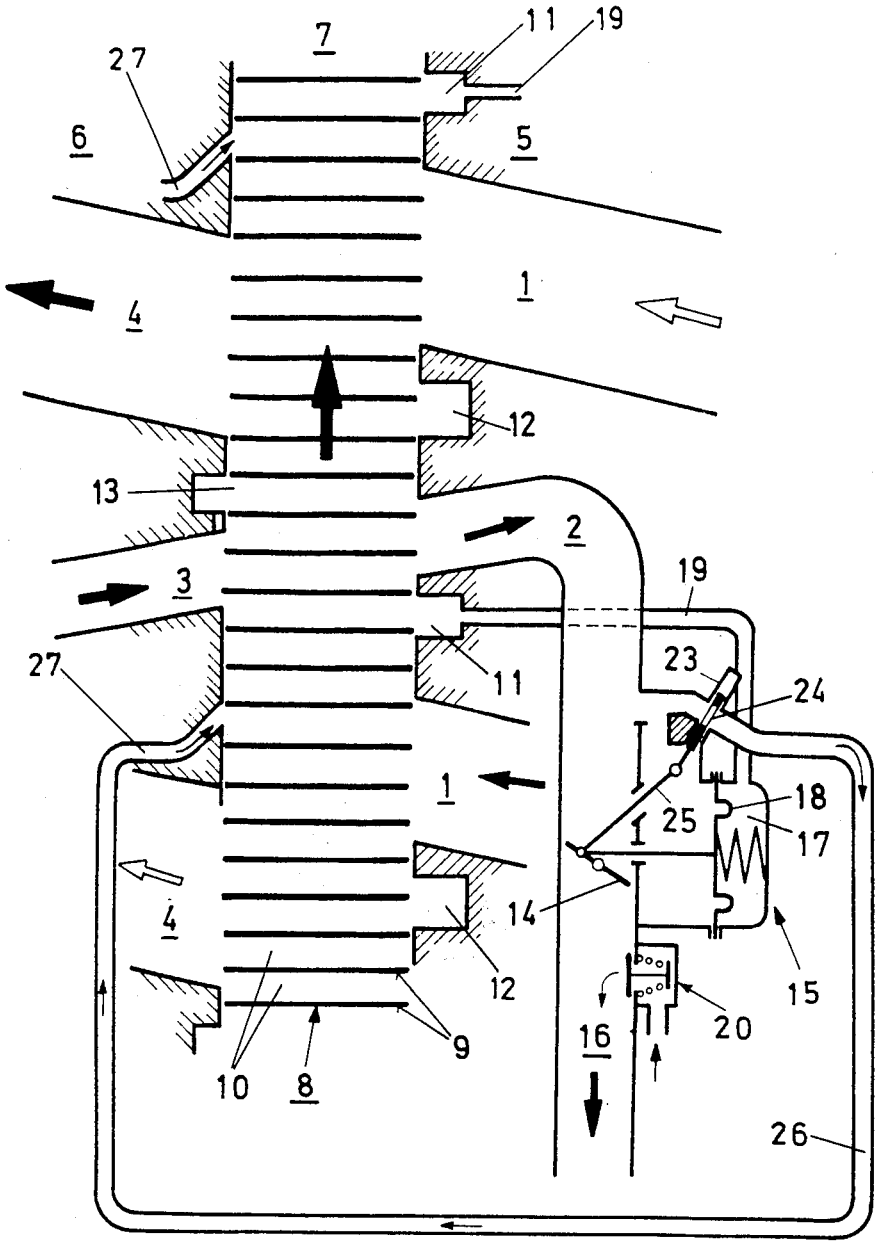

The design in FIG. 2 based on the same principle differs from that described previously in that the driving line 26 emerges from the gas casing 6 in the land between the low-pressure exhaust-gas port 4 and the high-pressure exhaust-gas port 3. The slot-shaped nozzle 27, which extends over the whole of the cell height, is thus provided in the land between the high-pressure exhaust-gas port 3 and the low-pressure exhaust-gas port 4 at a position at which pressure relief to the induction air port 1 can take place via the cell subject to the flow because otherwise back-up could occur in the relevant cell. The nozzle can be made cylindrical or conical in the region where it emerges which, as for the nozzle 22 in FIG. 1, also applies to all the other nozzles of this type. There is no difference relative to the design first mentioned with respect to the mode of operation of the control device 15.

After the supercharge air flap 14 has been opened, the breather valve 20 remains closed due to the excess pressure of the supercharge air relative to the ambient air pressure and the engine receives its combustion air exclusively via the pressure wave supercharger.

Figure 3:
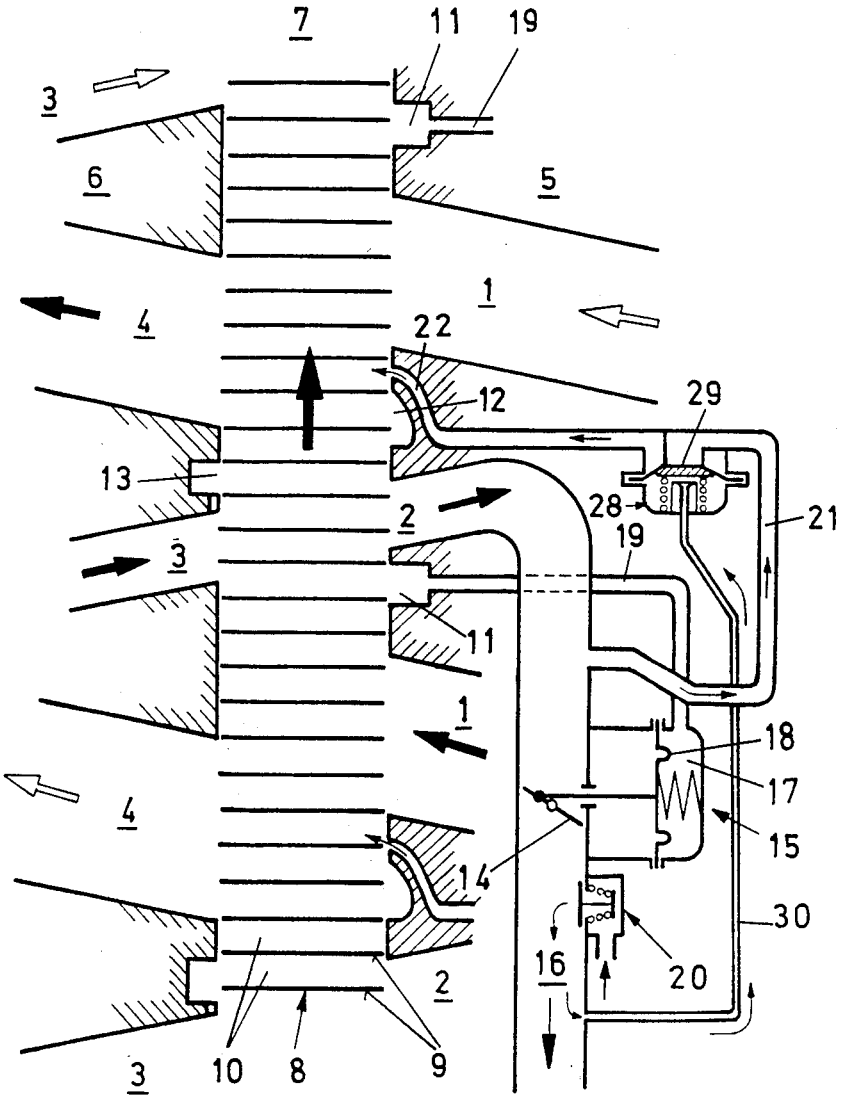

FIG. 3 shows a variant of the type first mentioned. It differs from the latter in the control of the flow of driving medium from the supercharge air port 2 to the nozzle 22 in the land between the expansion pocket 12 and the induction air port 1. For this purpose, a spring loaded diaphragm valve 28 is provided instead of a slide 23 (coupled with the supercharge air flap actuation) in the driving line 21. The upper surface of the diaphragm 29 can be subjected in operation to the pressure from the supercharge air port 2 and its lower surface can be subjected to the pressure from the supercharge air line 16 via a control pressure line 30. As long as the supercharge air flap 14 is closed, the dominant pressure is the supercharge air port 2 pressure, which acts via the line 21 on the diaphragm 29, raises the latter from its seal seating and thus frees the path to the nozzle 22. As soon as the flap 14 has been opened by a sufficiently strong supercharge air flow, the pressures on both sides of the diaphragm 29 are the same and the flow to the nozzle 22 is therefore shut off so that the drive occurs by the high-pressure exhaust-gas alone.

Figure 4:
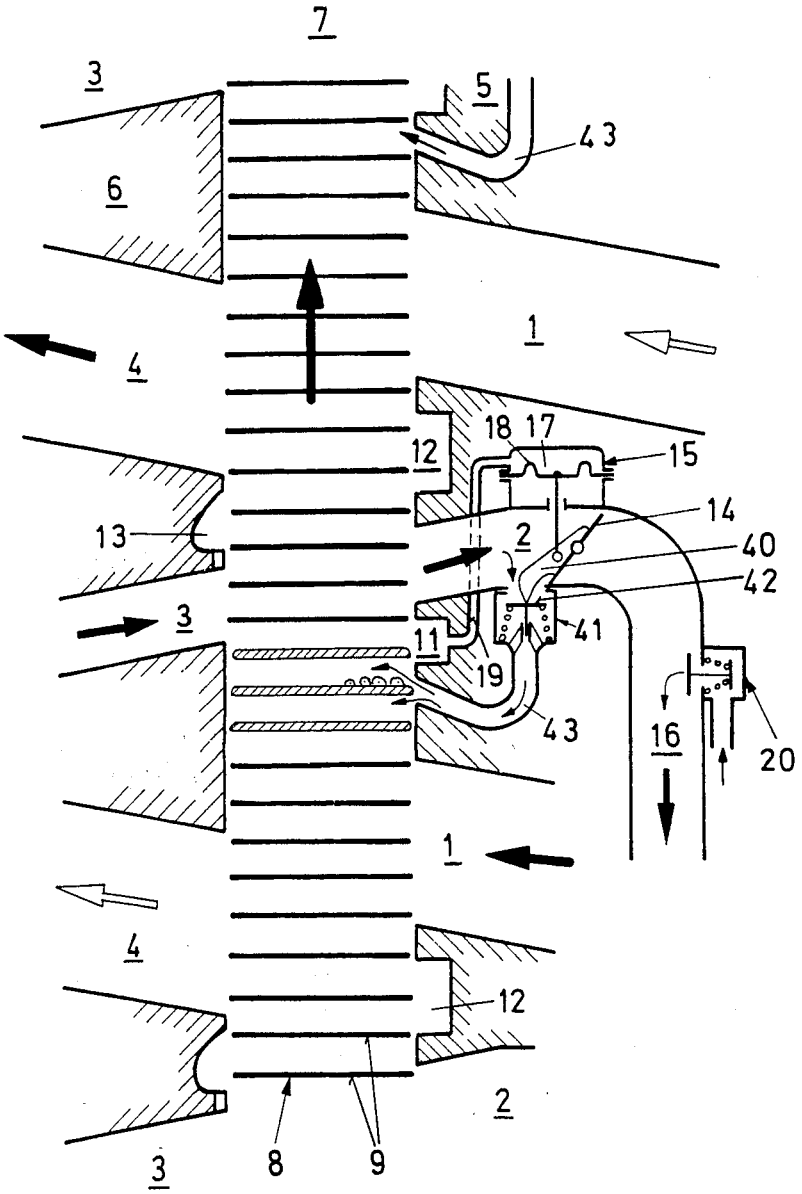

FIG. 4 shows a further possibility for using the compressor air from the supercharge air port for running up the rotor in the starting phase. The device 15 for controlling the supercharge air flat 14 corresponds substantially to that of FIG. 1 but the flap 14 has a hook-shaped nose 40 on its back whose point, when the flap 14 is closed, presses on a closing element in the form of a spring-loaded plate 42 of a plate valve 41 located upstream of the flap 14. By means of this arrangement, the air (backed-up in front of the flap 14) is blown against the cell walls 9 via a driving line 43, which is connected to the valve 41 and emerges in front of the compression pocket 11 in the rotor casing 7. As long as the pressure in the compression pocket 11 acting via the control pressure line 19 on the upper surface of the diaphragm 18 exceeds the supercharge air pressure in front of the flap 14, the valve 41 remains open. During this period, the combustion air is induced via the breather valve 20. After a certain rotor speed, at which a pressure sufficiently high for supercharge operation of the engine has built up, has been reached, this pressure exceeds the pressure occurring in the compression pocket 11 and presses the diaphragm 18 upwards thus pivoting the flap 14 into the opened position. The nose 40 simultaneously frees the plate 42, which then shuts off the supercharge airflow into the driving line 43.

In this design, the valve 41 also functions as a safety valve in the case of failure of the wastegate through which excess supercharge air is normally carried away.

In all the previously described designs and in those described below, the nozzles mentioned for driving the rotor, just as the main and auxiliary ports in the air and gas casings mentioned in the introduction, extend over the complete height of the rotor cells and correspondingly, in the case of multiple flute rotors, over the height of the cells in the available flutes with radial interruptions.

Figure 5:
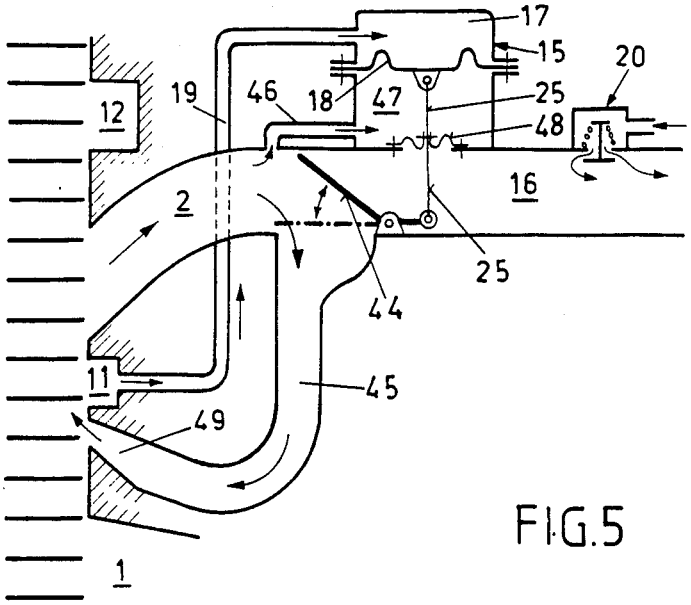

FIG. 5 shows a variant of the previously described design, in which a supercharge air flap 44 shuts off the supercharge air line 16 during the starting phase and the flow from the port 2 into a driving line 45 during operation under load. The flap 44 in this case therefore simultaneously also undertakes the function of the plate valve 41 in FIG. 4 with the exception of the function as a safety valve when the wastegate fails. This position of the flap 44 in operation under load is shown dash-dotted. Since, because of the single-sided deflection of the flap 44 to the wall of the duct 16, the space 47 subject to supercharge air in the diaphragm capsule underneath the diaphragm 18 is located downstream of the flap 44, a ventilation line 46 branches off from the port 2 upstream of the upper, free edge of the flap 44 and this ventilation line 46 enters into the space 47. The space 47 is sealed by a rubber collar 48, which also encloses the rod 25 to as to seal it, against the supercharge air line 16. The driving line 45 contracts to a nozzle 49 before entering the rotor space so as to increase the velocity of the driving jet.

Another possibility of increasing the drive torque in the starting phase on the exhaust-gas side is to restrict the exhaust-gas flow. In the case of single-flute pressure wave superchargers with two cycles, this can be achieved by temporarily shutting off one of the two cycles and, in the case of two-flute superchargers, by shutting off one of the two flutes and, if necessary, in addition one of the two cycles of the other flute. By "flute" is here meant an independent, functional cell ring of a rotor with the associated ports, pockets etc. in the gas and air casings. In the case of a double-flute pressure wave supercharger, the rotor has two coaxial cell rings on one rotor hub, the exhaust-gas and air-side ports and pockets of the cell rings being located in one casing each.

Figure 6:
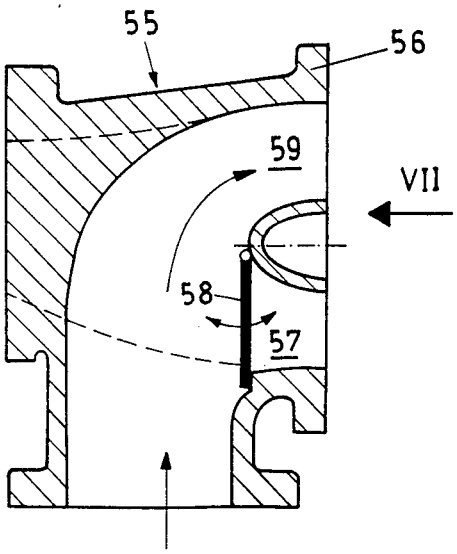
FIGS. 6–8 are views of devices in the gas casing for concentrating the high pressure exhaust gas onto individual cycles and/or channels of the pressure wave supercharger in the acceleration phase.
Figure 7:
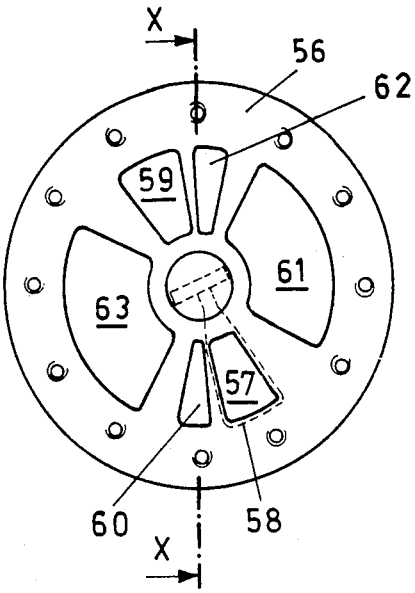

FIGS. 6 and 7 show diagrammatically, in section, the gas casing 55 of a single-flute supercharger with two cycles and a side view of the flange 56 of the casing 55 corresponding to the projection direction VII shown in FIG. 6. A shut-off flap 58 is provided in the high-pressure exhaust-gas port 57 of the lower cycle, this flap being pin-jointed to the central guide body. In the closed position shown, the port 57 is shut off so that the total exhaust-gas flow enters the high-pressure exhaust-gas port 59 of the upper cycle. The lower cycle also includes the gas pocket 60 and the exhaust gas port 61, the upper cycle similarly including the gas pocket 62 and the exhaust port 63.

Figure 8:
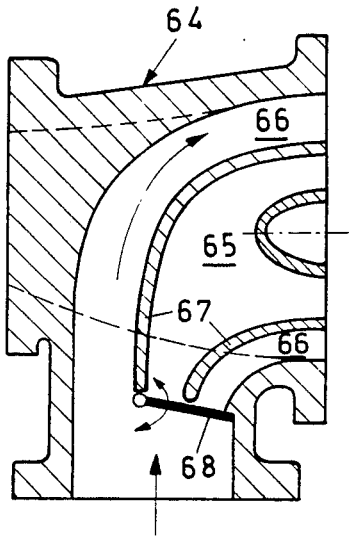

FIG. 8 shows an axial section through the gas casing 64 of a double-flute pressure wave supercharger. The two inlet flow ports 65 and 66 of the two flutes are separated by a partition 67. In this case, it is not only the inlet flow port 65 of the inner flute which is cut off by a shut-off flap 68 but also the lower cycle of the outer flute of the exhaust-gas flow. In consequence, the upper cycle of the outer flute receives, in the starting phase, a multiple of the exhaust-gas flow relative to a design without flute and cycle shut-off. The rotor is therefore subjected to four times the exhaust-gas velocity and it is correspondingly brought more rapidly to a speed permitting the engine to provide power.

In all the variants shown, nozzles supplied with air, acting together with the high-pressure exhaust-gas jet and possibly the induced air jet, ensure rotor run-up. The two latter measures then undertake the drive of the pressure wave supercharger when the engine is operating under load after the nozzles have been switched off.

In the starting phase, it is important to keep the leakage losses through the clearance between the rotor and the casing walls as small as is practically possible in order to make the maximum use of the flow of the media for driving the rotor. The rotor/casing surface material pair has to be matched to this requirement. This suggests, inter alia, pairing a rotor in mineral ceramic with a casing surface of steel. During the starting phase, the rotor rapidly becomes hot but only changes its dimensions to an unimportant extent because of the small thermal expansion coefficient of mineral ceramic. Although the steel of the casing surface has a much higher thermal expansion coefficient than mineral ceramic, it remains cooler than the rotor during the starting phase so that only small casing clearances form and the leakage losses remain small. As soon as the casing surface has taken up its steady state operating temperature, the clearances are of course substantially larger but the leakage losses remain small relative to the mass flow in operation under load and can therefore be accepted.

The designs described up to now themselves substantially permit the running up of the rotor 8 from the rest condition of the pressure wave machine to the point of achieving a supercharge pressure sufficient for satisfactory running of the engine with power output. This device has to be combined with other means for driving the pressure wave supercharger over the whole of the rest of the low range. A most obvious measure to this end is drive by means of the high-pressure exhaust gas, supported by the induced air, as is described in more detail in the discussion of FIG. 1.

Figure 9:
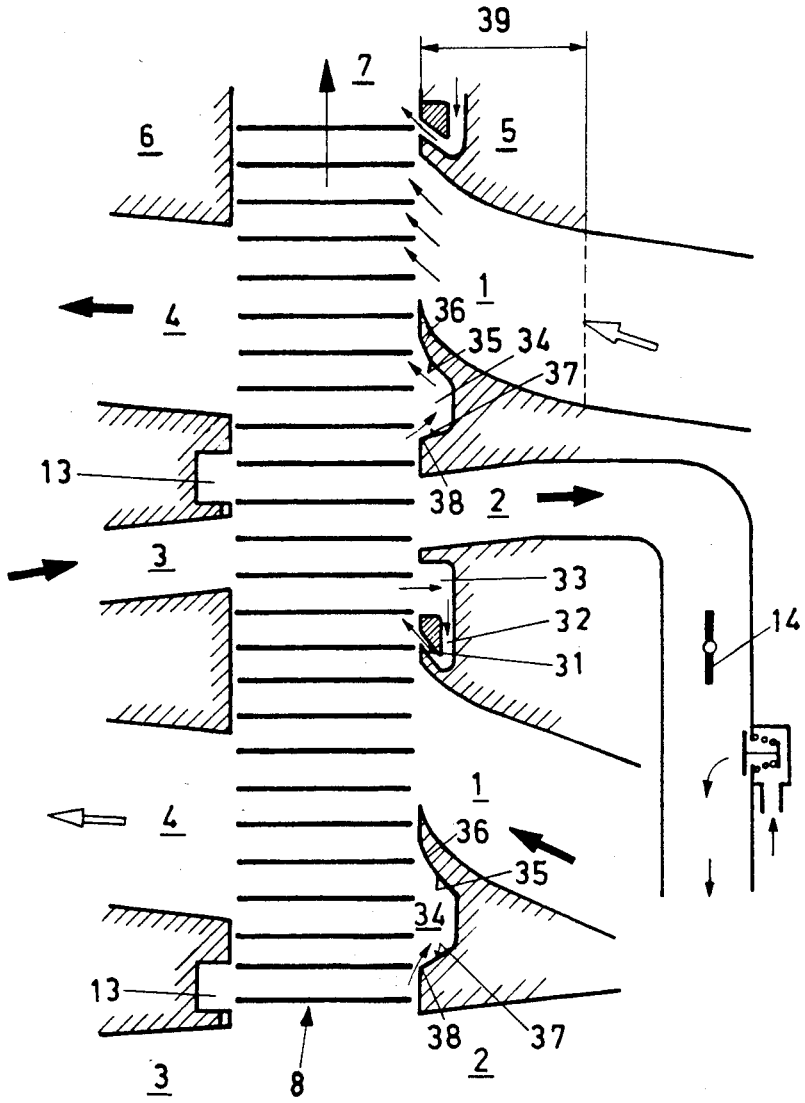
FIG. 9 shows a design with a nozzle in the land in front of the front of the compression pockets of the air casing for driving the rotor during load operation.

FIG. 9 shows a suitable device for this purpose which also acts as a run-up aid for the rotor during the starting phase and in which the torque at low engine speeds, particularly in idling operation, is self-regulating. Since the same device as that in FIGS. 1–3 is used for controlling the supercharge air flap 14, it is not shown and only the supercharge air flap 14 itself is shown diagrammatically. Where the other elements agree in form and function with the designs analogous to those earlier described, they are provided with the same reference numbers.

In this design, a nozzle 31 is again provided in the air casing 5 but this nozzle is located between the induction air port 1 and the compression port 33. This nozzle 31 is supplied via a short transfer port 32 from the compression pocket 33, in which the pressure is higher than it is upstream of it in front of the closing edge of the port 1. Since this applies for the whole of the operating range, this nozzle 31, has a driving action over the whole of the operating range, particularly at low engine speeds and in the lower idling range where the compression pocket 33 is particularly effective, to which is added, after the run-up phase, the driving action of the high-pressure exhaust gas from the port 3 and, to a lesser extent, the induction air from the port 1.

Another measure which contributes to the driving torque is the formation of an expansion pocket 34 with an oblique wall part at least on the side of its closing edge 36, but advantageously also with an oblique wall part 37 on the side of it's opening edge 38. In both cases, the gas enters the rotor cells with a clearly defined peripheral component; in the case of two oblique wall parts, this peripheral component is even greater because the gas after the opening edge 38 already enters the pocket 34 with a larger peripheral component from the arriving cells.

The induction air ports 1 in the design shown in FIG. 9 differ from the form shown in FIGS. 1–4 in that they enter the rotor space at a flatter angle relative to the peripheral direction of the rotor so that the induction air enters with a larger peripheral component relative to the designs mentioned and supplies a larger drive torque. The flatter entry of the port 1 is obtained by a curved entry section 39 whose side walls, shortly before entry, are preferably designed to be approximately parallel to the wall part 35 of the expansion pocket 34 and to the nozzle 31 before the compression pocket 33.

Figure 10:
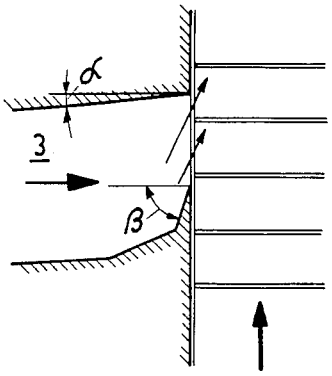
FIG. 10 shows a special design of a high pressure exhaust-gas port with driving gas jets strengthened relative to the normal design for load operation.

FIG. 10 shows how the driving jet can be deflected in a direction with a larger peripheral component of the inlet velocity by means of a nozzle-type contraction of the high-pressure exhaust-gas port 3 before its entry into the rotor space in order to achieve a larger torque in the load range. Values of 0–10° and approximately 75–80° have been found favorable for the angles $\alpha$ and $\beta$, respectively. A driving jet deflected in this matter generates a high driving torque and, in consequence, provides short response times of the supercharger when the load on the engine rapidly increases.

Figure 11:
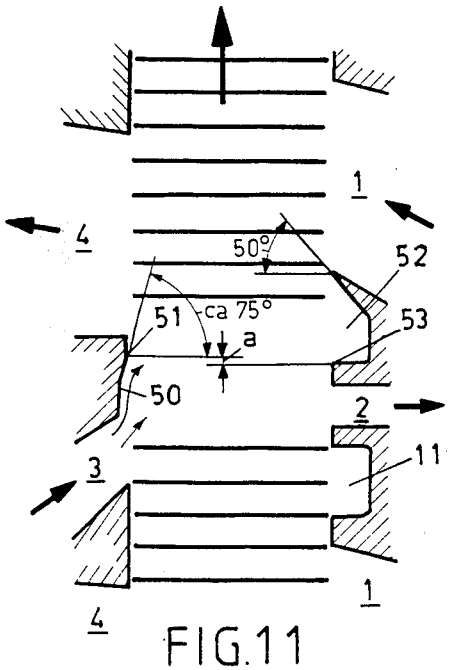
FIG. 11 also shows a design with strengthened driving gas jet and special arrangement of the expansion pockets for load operation.

Even more effective in this respect is a wedge gas-pocket inlet port 50, as shown in FIG. 11, which extends from the entry of the port 3 to beyond the opposite opening edge 53 of an expansion pocket 52, seen in the direction of rotation of the rotor. In other words, the closing edge 51 of the supply port 50 is located, seen in the direction of rotation of the rotor, after the opening edge 53 of the expansion pocket 52, employing an oblique outlet flow wall. Starting from the opening edge 53 as the reference point and considering the direction of rotation of the rotor as positive, the condition described above may be expressed by saying that $\alpha$ must be greater than 0. Maintaining this condition ensures that, even with a stationary rotor, a drive torque is generated via the expansion pocket 52. Ths also gives the possibility of allowing the engine exhaust gases to flow through the pressure wave supercharger when at rest in order, if necessary, to heat it or de-ice it. The inlet flow wall for this expansion pocket 52 is located parallel to the axis of the rotor but it can also, as in the design of FIG. 9, be oblique—which increases the driving effect of the pocket 52.

In the case of the wedge gas-pocket inlet flow port 50, an angle of approximately 75° relative to the direction of the rotor axis has been found to be advantageous for the inclination of the outlet flow wall. In the case of the outlet flow wall of the expansion pocket 52, 50° is correspondingly valid as the favorable value for the obliquity.

As already mentioned, the induction air flowing from the port 1 can also contribute to the drive of the free-running rotor, particularly in the low speed range because of its large quantity and high density. So that it does not have a braking effect on the rotor, its velocity component in the peripheral direction must, at every point, be at least equal to the peripheral velocity of the rotor cell walls at the relevant point. For a particular inclination of the port axis, a particular air throughput is associated with each rotor speed so that shall be the case. If the air throughput is higher, the inlet velocity of the air and hence its peripheral component is greater than is necessary for shock-free entry—it therefore has a driving effect on the rotor.

Figure 12:
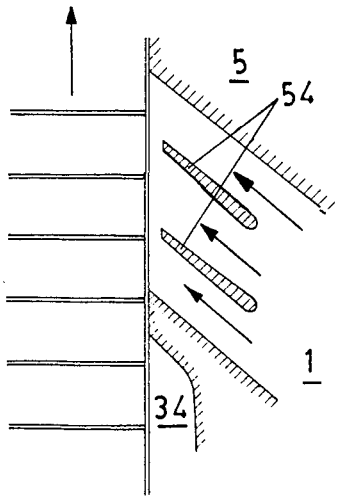
FIG. 12 shows a special design of the low pressure air port for strengthening the driving air jet.

FIG. 12 shows how the large quantity of induced air in port 1, which, after its entry into the rotor cells, acts initially as scavenging air for ejecting the expanded exhaust gases, can be made even more useful for driving purposes. By means of one or, as shown, two guide ribs 54, the air is accelerated before its entry into the rotor space and the drive torque is increased. In order to prevent formation of eddies due to oblique instant flow, the leading edges of the guide ribs are well rounded. Due to the contraction of the flow in the entry region, the maintenance of the favorable cell-wall incident flow angle is also ensured more effectively than in the absence of guide ribs. The particularly important point is to prevent separation of the flow on the wall part associated with the opening edge of the port 1. This means that the guide rib adjacent to the opening edge should be located sufficiently near to the wall part mentioned that separation of the flow is prevented. This is important because the main suction wave occurs on the opening edge, this being a precondition for a good scavenging effect. Compared with an eddying, undirected flow in this wall region, this provides an increased scavenger quantity and, in consequence, an improved drive torque.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A free-running pressure wave supercharger to be driven by the exhaust-gas flow of an internal combustion engine, comprising:

a rotor casing having two end surfaces, a cell rotor with cell walls within the rotor casing, an air casing and a gas casing on the two end surfaces of the rotor casing, a low-pressure air port for the supply of low-pressure air in the air casing, a high pressure air port in the air casing for the removal of high pressure air, a high-pressure exhaust-gas port for the supply of high-pressure exhaust-gas in the gas casing, a low pressure exhaust gas port in the gas casing for the removal of low pressure exhaust gas, a compression pocket arranged in the air casing after the low-pressure air port and before the high-pressure air port, an expansion pocket arranged in the air casing after the high-pressure air port and before the low-pressure air port, a gas pocket arranged in the gas casing between the two exhaust-gas ports, a bearing for accepting the rotor shaft in the air casing, said high-pressure exhaust-gas port and said low-pressure exhaust-gas port arranged so as to subject the cell walls of the cell rotor to high-pressure exhaust gas for the purpose of generating an impulse on the cell walls acting in the direction of rotation of the rotor, said high-pressure exhaust-gas port and said low-pressure air port entering the rotor casing at an acute angle, referred to the vector of the rotor peripheral velocity, a supercharge air line in communication with said high-pressure air port, a supercharge air flap and a breather valve in the supercharge air line, a control device being effectively connected to the supercharge air flap, the control device being activatable by a pressure pulse signal derived from the pressure wave process, said cell rotor and the rotor casing arranged so as to maintain a small as possible clearance between the end surfaces of the cell rotor and the air casing and the gas casing in the run-up phase of the pressure wave supercharger in order to keep the leakage losses of the exhaust gases and the air as small as possible, port means for subjecting the cell walls of the cell rotor to gas action, said port means being located in one of the air casing and the gas casing and enter into the rotor casing, wherein the geometrical axes of the port means enclose an acute angle with the peripheral velocity vector of the rotor in the region of their entry into the rotor casing, said port means are each passage-connected with a position on the casing in which it is provided at which a positive pressure is present relative to the entry of these ports in the rotor casing, the control device being in effective connection with the supercharged air flap provided in the high-pressure air port, said control device adapted to hold the supercharged air flap closed in the starting phase of the engine and, at the same time, relieve the high-pressure air port in such a way that gases escaping from the high-pressure air port are supplied to the port means.

2. The pressure wave supercharger as claimed in claim 1, wherein, for each cycle, the port means enters the air casing between the expansion pocket and the low-pressure air port and is there contracted to form a nozzle and further comprising a drive line connecting the port means to a position in the high-pressure air port located upstream of the supercharge air flap.

3. The pressure wave supercharger as claimed in claim 1, wherein, for each cycle, the port means ends in a nozzle which enters the rotor casing between the low-pressure exhaust-gas port and the high-pressure exhaust-gas port in the gas casing and further comprising a drive line which connects the port means with a position in the high-pressure air line located upstream of the supercharge air flap.

4. The pressure wave supercharger as claimed in claim 1, further comprising, for each cycle, a port which ends in a nozzle which enters the rotor casing immediately in front of the opening edge of the compression pocket in the air casing and is connected to the compression pocket via the port.

5. The pressure wave supercharger as claimed in claim 1, further comprising, for each cycle, a nozzle which enters the rotor casing before the opening edge of the compression pocket and a drive line connecting the nozzle with a position in the high-pressure air line located upstream of the supercharge air flap.

6. The pressure wave supercharger as claimed in claim 2, wherein the high-pressure exhaust-gas port has a nozzle in the region of its entry into the rotor casing, the opening edge side wall part of the high-pressure exhaust-gas port being inclined at an angle of between 75° and 80° and the closing edge side wall part is inclined at an angle $\alpha$ of between 0° and 10°, both angles being measured relative to a normal to the end surfaces of the rotor.

7. The pressure wave supercharger as claimed in claim 2, wherein the high-pressure exhaust-gas port expands into a wedge gas-pocket inlet flow port extending downstream in the region of its entry into the rotor casing, the closing edge side wall part of said wedge gas-pocket inlet flow port being inclined at an angle of approximately 75°, measured relative to a normal to the end surfaces of the rotor, and the closing edge of the wedge gas-pocket inlet flow port is located, seen in the direction of rotation of the rotor, after the opening edge of the expansion pocket in the air casing.

8. The pressure wave supercharger as claimed in claim 1, wherein the expansion pocket has oblique wall part on both the opening edge and the closing edge, the angle of the oblique wall part adjacent to the closing edge being about 50°, measured relative to a normal to the end surface of the rotor.

9. The pressure wave supercharger as claimed in claim 2, wherein the control device includes a diaphragm capsule with a diaphragm, a valve device and a control pressure line in connection with the compression pocket and the valve device for the drive line, the diaphragm being subjected on one side to the pressure in the control pressure line and, on the other side, to the pressure in the high-pressure air line, wherein the supercharge air flap is in effective connection with the diaphragm, and the valve device in such a way that when the supercharge air flap is closed, the valve device releases the flow through the drive line and, when the supercharge air flap is open, the flow through the drive line is shut off.

10. The pressure wave supercharger as claimed in claim 9, further comprising a hook-shaped nose attached to the supercharge air flap for effective connection between the supercharge air flap and the valve device, a plate which forms the closing element of the valve device being in positive connection with the peak of the nose.

11. The pressure wave supercharger as claimed in claim 9, further comprising a supercharge air line that is connected to the control pressure line, wherein the valve device in the drive line is a diaphragm valve whose diaphragm forms the closing element which is subjected on one side, via the drive line, to the pressure in front of the closed supercharge air flap and, on the other side, is subjected to the pressure after the closed supercharge air flap via the control pressure line which is connected to the supercharge air line downstream of the supercharge air flap.

12. The pressure wave supercharger as claimed in claim 5, wherein the supercharge air flap is supported immediately behind a branch of the drive line from the high-pressure air line in such a way that it completely closes the entry cross-section of the branch when the flow cross-section of the high-pressure air line is free and the control device includes a diaphragm capsule and a control pressure line connected to the compression pocket for the control of the supercharge air flap.

13. The pressure wave supercharger as claimed in claim 1, said cell rotor comprising a single-flute rotor, further comprising a shut-off flap provided in the high-pressure exhaust-gas port of one of two cycles which shut-off flap is held closed in the run-up phase of the pressure wave supercharger by a pressure difference typical of the pressure wave process.

14. The pressure wave supercharger as claimed in claim 1, said cell rotor having two flutes, further comprising a shut-off flap in the high-pressure exhaust-gas port in the inlet port to the inner flute, which shut-off flap is help closed in the run-up phase of the pressure wave supercharger by a pressure difference typical of a pressure wave process.

15. The pressure wave supercharger as claimed in claim 1, said cell rotor having two flutes, further comprising a shut-off flap in the high-pressure exhaust-gas port, which shut-off flap is actuated by a pressure difference typical of a pressure wave process during the run-up phase of the pressure wave supercharger and holds the inlet flow port to the inner flute and the inner flow port to the lower cycle of the outer flute closed.

16. The pressure wave supercharger as claimed in claim 1, further comprising at least one guide rib in the entry region of the low-pressure air port, the guide rib being located in such a way that it prevents separation of the flow in the region of the opening edge.

17. The pressure wave supercharger as claimed in claim 1, wherein the expansion pocket has an oblique wall part adjacent to the closing edge of the expansion pocket, the angle of the oblique wall part being about 50° measured relative to a normal to the end surface of the rotor.

18. The pressure wave supercharger as claimed in claim 1, wherein the cell walls of the cell rotor are parallel to the axis of the rotor.

19. The pressure wave supercharger as claimed in claim 1, wherein the cell walls of the cell rotor are oblique to the axis of the rotor.

20. The pressure wave supercharger as claimed in claim 1, wherein the cell walls of the cell rotor are helically twisted.

* * * * *